US010859301B2

(12) United States Patent
Wantland et al.

(10) Patent No.: US 10,859,301 B2
(45) Date of Patent: Dec. 8, 2020

(54) REFRIGERATOR APPLIANCE AND ICE BIN ASSEMBLY

(71) Applicant: Haier US Appliance Solutions, Inc., Wilmington, DE (US)

(72) Inventors: Louis A. Wantland, Louisville, KY (US); Gaurav Sanjay Katre, Pune (IN); Lauren Nicole Platts, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 105 days.

(21) Appl. No.: 16/108,380

(22) Filed: Aug. 22, 2018

(65) Prior Publication Data

US 2020/0064045 A1 Feb. 27, 2020

(51) Int. Cl.
*F25C 5/182* (2018.01)
*F25C 5/20* (2018.01)

(52) U.S. Cl.
CPC ..... *F25C 5/182* (2013.01); *F25C 5/22* (2018.01); *F25C 5/24* (2018.01); *F25C 2400/10* (2013.01); *F25C 2700/12* (2013.01); *F25C 2700/14* (2013.01); *F25D 2700/121* (2013.01)

(58) Field of Classification Search
CPC .... F25C 5/182; F25C 5/24; F25C 5/22; F25C 2700/14; F25C 2400/10; F25C 2700/12; F25D 2700/121
USPC ..... 62/344
See application file for complete search history.

(56) References Cited

U.S. PATENT DOCUMENTS

| | | | | |
|---|---|---|---|---|
| 6,425,259 | B2 * | 7/2002 | Nelson | F25C 5/22 62/344 |
| 7,874,457 | B2 * | 1/2011 | Sowers | F25C 5/24 222/108 |
| 8,613,205 | B2 | 12/2013 | Flores et al. | |
| 9,644,878 | B2 | 5/2017 | Mitchell et al. | |
| 9,733,004 | B2 | 8/2017 | Mitchell et al. | |
| 9,869,502 | B2 | 1/2018 | Gardner et al. | |
| 9,874,386 | B2 | 1/2018 | Mitchell et al. | |
| 2009/0145157 | A1 * | 6/2009 | Jeong | F25C 5/22 62/344 |
| 2013/0263621 | A1 * | 10/2013 | An | F25D 11/02 62/344 |
| 2014/0196493 | A1 | 7/2014 | Mitchell | |
| 2015/0096310 | A1 | 4/2015 | Wait et al. | |
| 2016/0025399 | A1 | 1/2016 | Miller et al. | |
| 2017/0146280 | A1 | 5/2017 | Hitzelberger et al. | |
| 2017/0205132 | A1 | 7/2017 | Nuss et al. | |
| 2017/0211863 | A1 | 7/2017 | Nuss et al. | |
| 2018/0010837 | A1 | 1/2018 | Miller et al. | |
| 2018/0017305 | A1 | 1/2018 | Tarr et al. | |
| 2018/0017306 | A1 | 1/2018 | Miller | |

* cited by examiner

*Primary Examiner* — Steve S Tanenbaum
(74) *Attorney, Agent, or Firm* — Dority & Manning, P.A.

(57) ABSTRACT

A refrigerator appliance and ice bin assembly therefor are provided herein. The ice bin assembly or ice bin may be removably received within the chilled chamber. The ice bin may include a bin body, an ice sweep, and a gear assembly. The bin body may define a storage volume to receive ice therein. The ice sweep may be positioned within the ice bin. The gear assembly may be positioned within the ice bin below the ice sweep in mechanical communication in the ice sweep to motivate rotation of the ice sweep.

18 Claims, 16 Drawing Sheets

REFRIGERATOR APPLIANCE AND ICE BIN ASSEMBLY

FIELD OF THE INVENTION

The present subject matter relates generally to assemblies for storing and dispensing ice, and more particularly to ice bin assemblies for use in refrigerator appliances.

BACKGROUND OF THE INVENTION

Certain refrigerator appliances include an ice maker. In order to produce ice, liquid water is directed to the ice maker and frozen. A variety of ice types can be produced depending upon the particular ice maker used. For example, certain ice makers include a mold body for receiving liquid water. An agitator or ejector within the mold body can rotate and scrape ice off an internal surface of the mold body to form ice nuggets or cubes. Once ice is scraped off the mold body, it may be stored within an ice bin or bucket within refrigerator appliance. In order to maintain ice in a frozen state, the ice bin is positioned within a chilled chamber of the refrigerator appliance or a separate compartment behind one of the doors. In some appliances, a dispenser is provided in communication with the ice bin to automatically dispense a selected or desired amount of ice to a user (e.g., through a door of the user appliance). Typically, a rotating agitator or sweep is a provided within the ice bin to help move ice from the ice bin to the dispenser.

Although delivery of ice through, for example, a door of a refrigerator appliance may be useful, existing systems present a number of problems. As an example, it may be difficult to see ice within the ice bin. As another example, there may be instances when a user may wish to remove an ice bin from the refrigerator appliance. However, removal of an ice bin can be difficult and cumbersome in many existing appliances. If an agitator or sweep is provided, it may be difficult to remove or manage the rotating agitator or sweep within an ice bin. Ice may periodically melt and refreeze within the ice bin, making it especially difficult to remove or rotate the sweep or agitator. In some existing appliances, a top opening of the ice bin (e.g., through which ice falls into the ice bin from the ice maker) must be kept relatively small so that the sweep or agitator can be supported at a top portion of the ice bin. A motor may be provided to drive the sweep or agitator. However, it may be difficult to arrange the motor and agitator connection in such a way that does not further restrict access to the ice bin or a user's ability to remove the ice bin from the refrigerator appliance.

As a result, there is a need for an improved refrigerator appliance and ice bin assembly. In particular, it would be advantageous to provide a refrigerator or ice bin addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chilled chamber, a door, and an ice bin. The door may be rotatable between an open position permitting access to the chilled chamber and a closed position restricting access to the chilled chamber. The ice bin may be removably received within the chilled chamber. The ice bin may include a bin body, an ice sweep, a gear assembly, and a retractable handle. The bin body may define a storage volume to receive ice therein. The ice sweep may be positioned within the ice bin. The gear assembly may be positioned within the ice bin below the ice sweep in mechanical communication with the ice sweep to motivate rotation of the ice sweep. The retractable handle may be mounted to the bin body and define a user grip. The retractable handle may be radially movable between a retracted position restricting access to the user grip and an open position permitting access to the user grip.

In another exemplary aspect of the present disclosure, a refrigerator appliance is provided. The refrigerator appliance may include a cabinet defining a chilled chamber, a door, and an ice bin. The door may be rotatable between an open position permitting access to the chilled chamber and a closed position restricting access to the chilled chamber. The ice bin may extend from a bottom end to a top end and be removably received within the chilled chamber. The ice bin may include a bin body, an ice sweep, a gear assembly, and a resilient catch. The bin body may define a storage volume to receive ice therein. The ice sweep may be positioned within the ice bin. The gear assembly may be positioned within the ice bin below the ice sweep in mechanical communication with the ice sweep to motivate rotation of the ice sweep. The resilient catch may be mounted at the bottom end. The resilient catch may be movable between a locked position and an unlocked position. The locked position may provide the resilient catch in contact with the internal latch and restrict radial movement of the ice bin relative to the door. The unlocked position may provide the resilient catch at a location spaced apart from the internal latch and permitting radial movement of the ice bin relative to the door.

In yet another exemplary aspect of the present disclosure, a refrigerator appliance is provided. The refrigerator appliance may include a cabinet defining a chilled chamber, a door, and an ice bin. The door may be rotatable between an open position permitting access to the chilled chamber and a closed position restricting access to the chilled chamber. The door may include an electrical contact plate. The ice bin may be removably received within the chilled chamber. The ice bin may include a bin body, an ice sweep, a gear assembly, and a light source. The bin body may define a storage volume to receive ice therein. The ice sweep may be positioned within the ice bin. The gear assembly may be positioned within the ice bin below the ice sweep in mechanical communication with the ice sweep to motivate rotation of the ice sweep. The light source may be fixed to the bin body and directed toward the storage volume to selectively illuminate the storage volume, the light source being in selective electrical engagement with the electrical contact plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
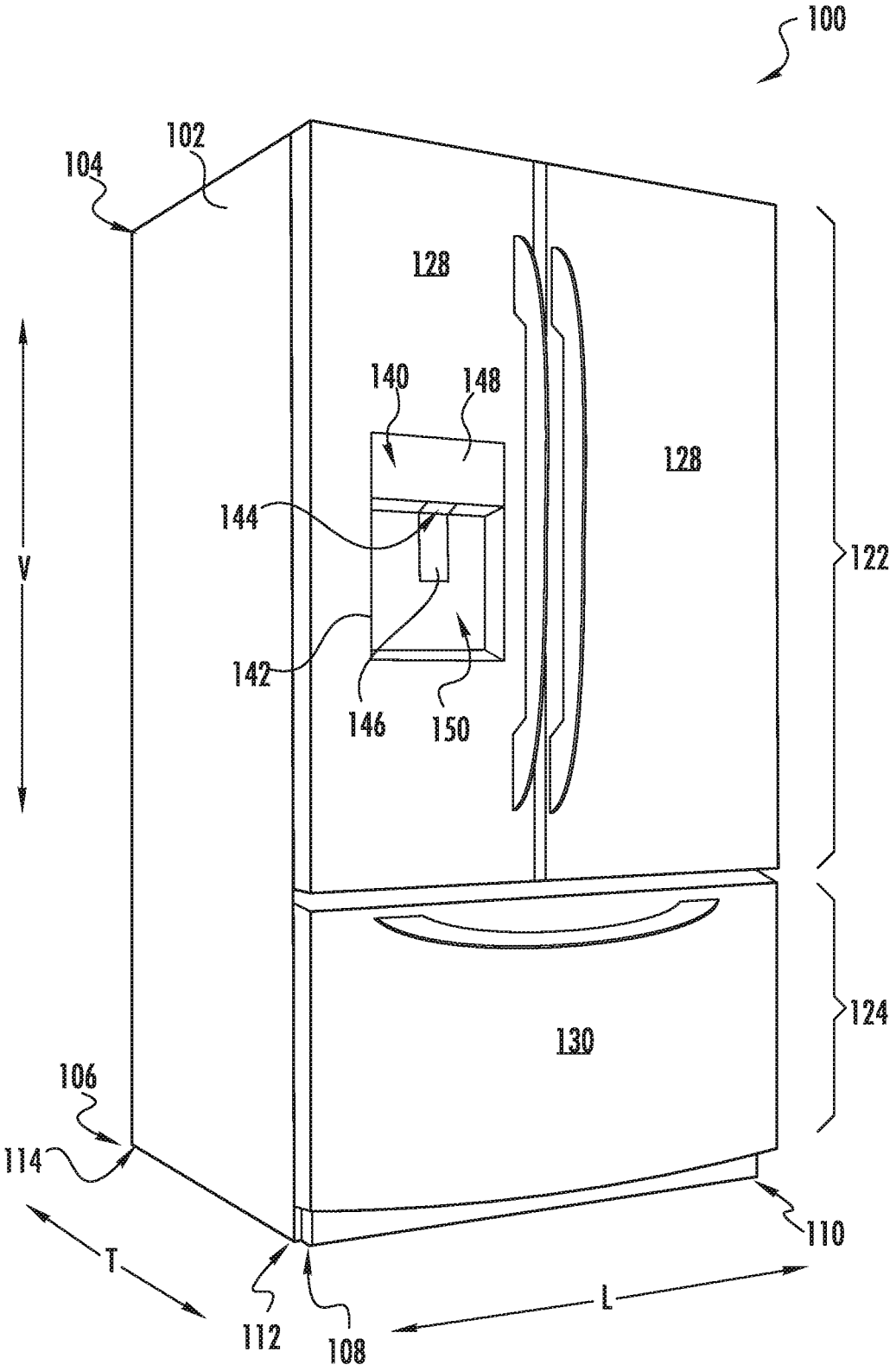
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
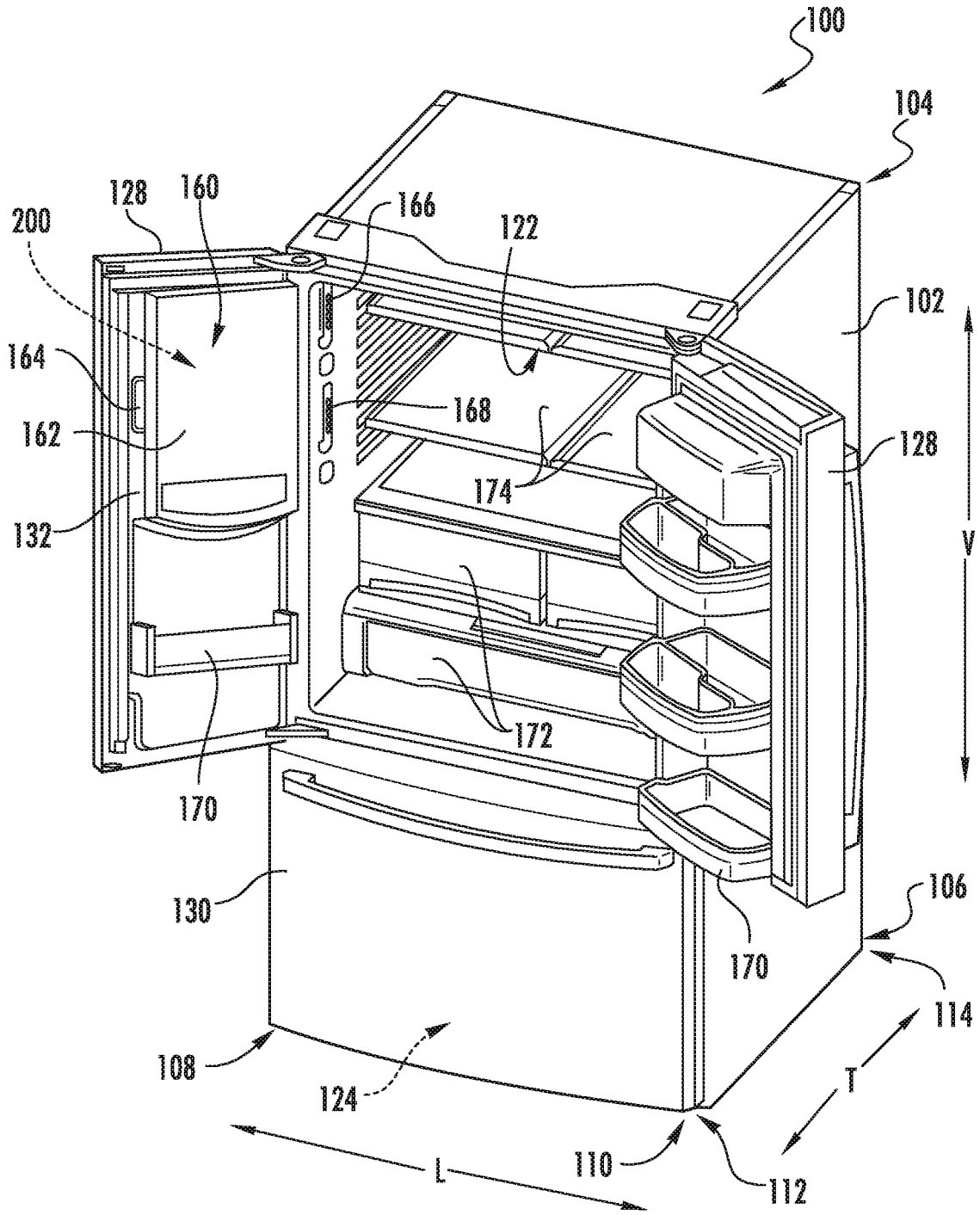
FIG. 2 provides a perspective view of a door of the example refrigerator appliance of FIG. 1.
Figure 3:
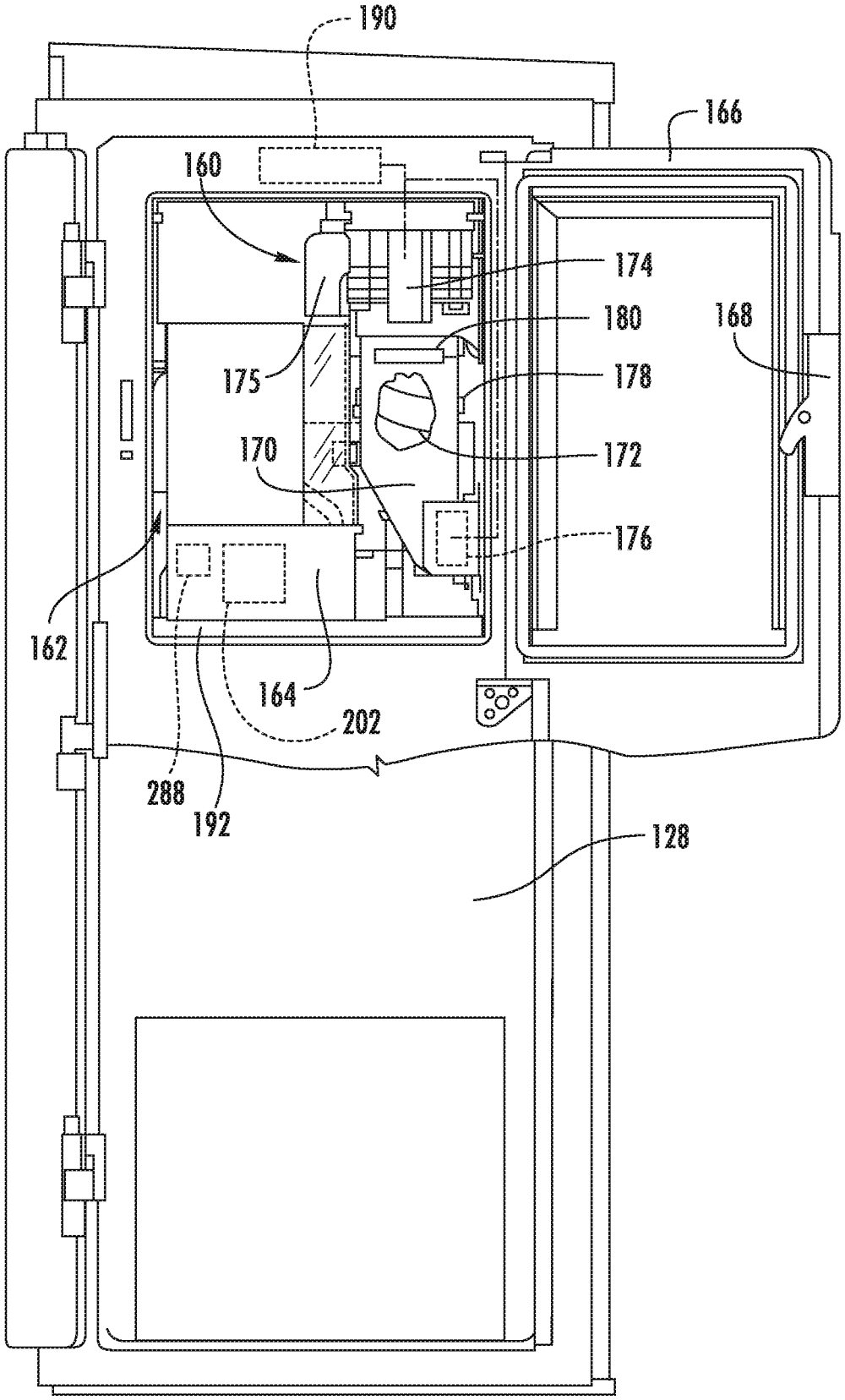
FIG. 3 provides an elevation view of the door of the exemplary refrigerator appliance of FIG. 2 with an access door of the door shown in an open position.

Turning now to the figures, FIGS. 1 and 2 provide perspective views of a refrigerator appliance 100 according to an exemplary embodiment of the present disclosure. FIG. 3 provides an elevation view of refrigerator door 128 with access door 166 shown in an open position.

As shown, refrigerator appliance 100 includes a cabinet or housing 120 that extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of doors 120). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 4:
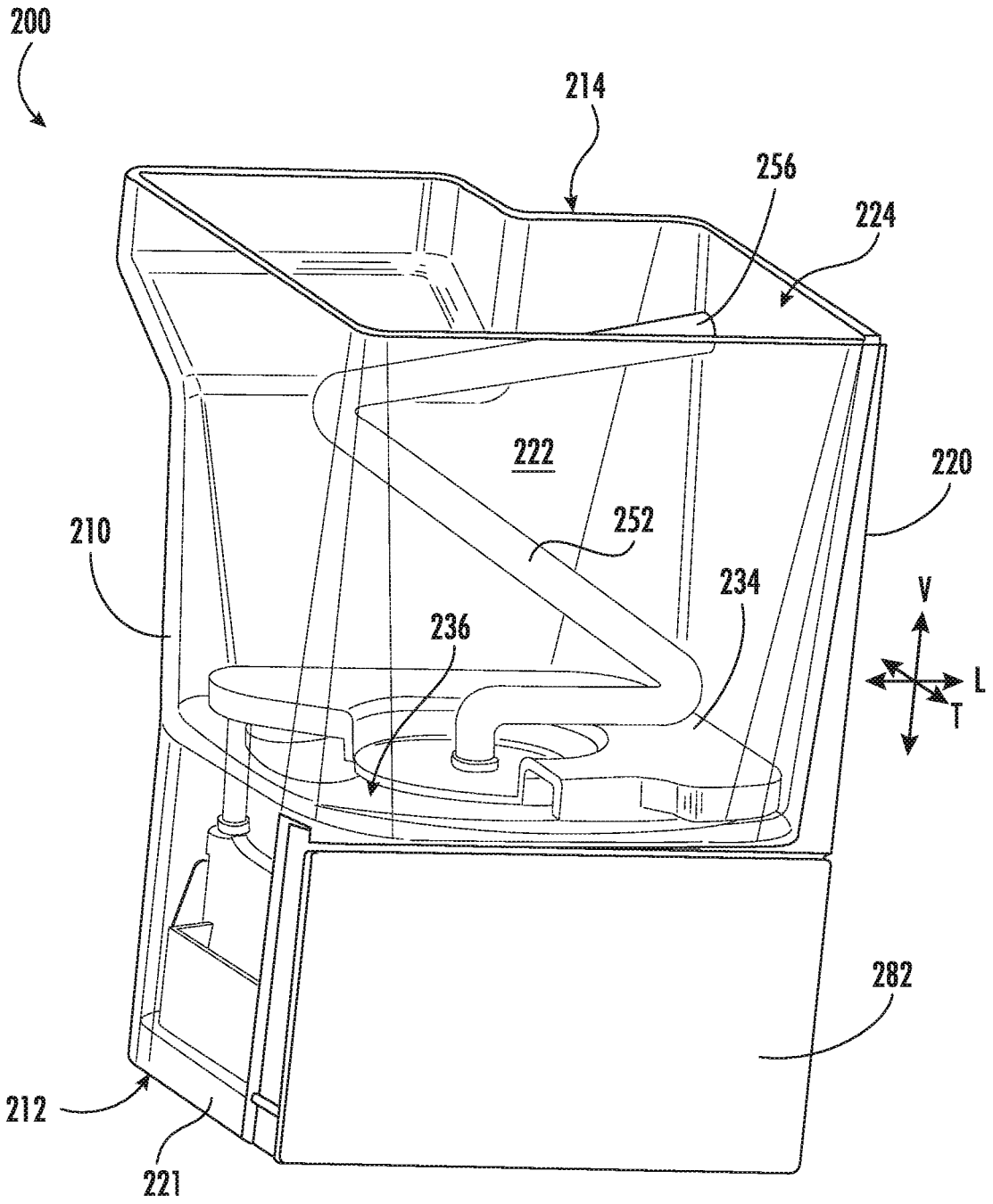
FIG. 4 provides a perspective view of a bin assembly for a refrigerator appliance according to exemplary embodiments of the present disclosure.
Figure 5:
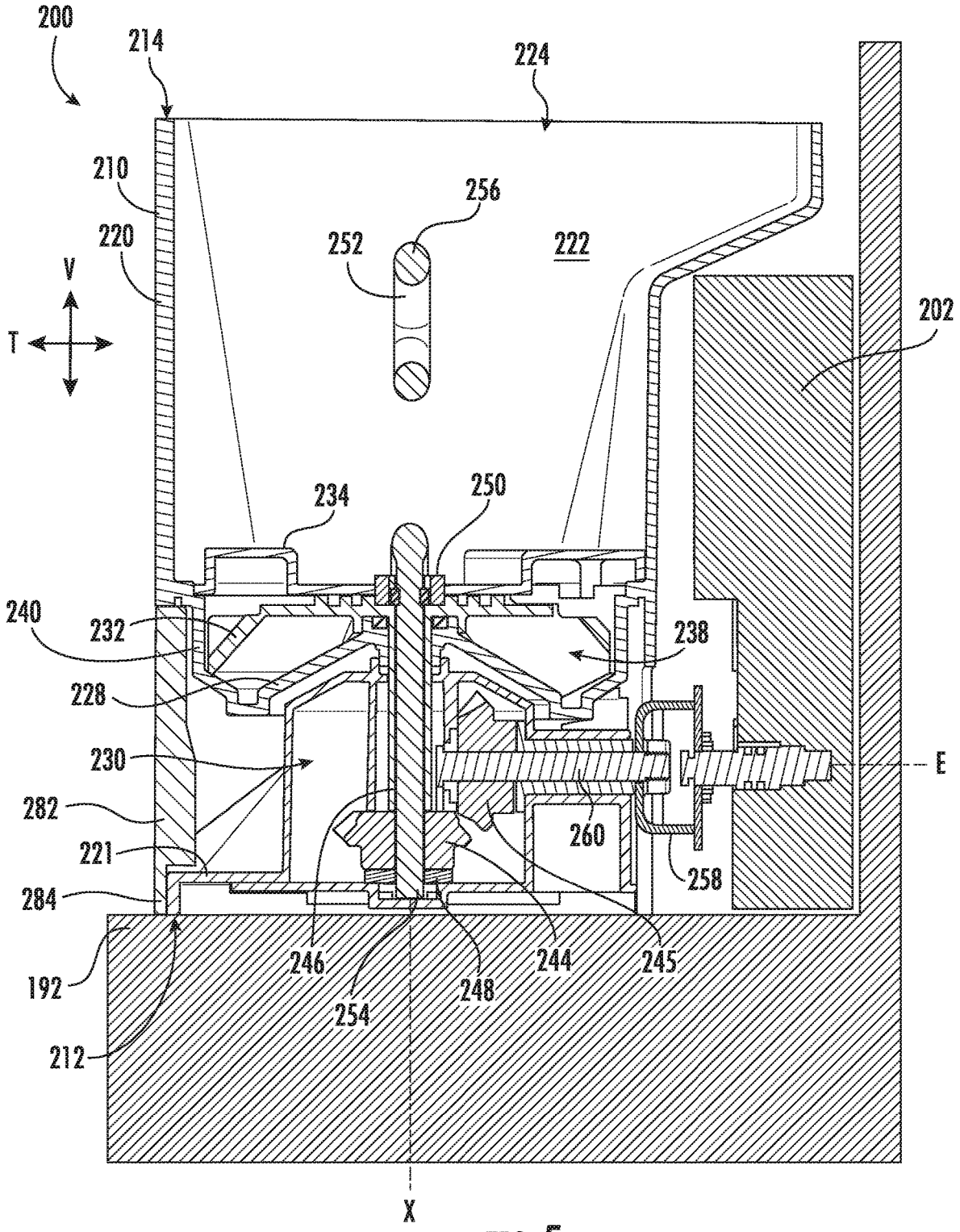
FIG. 5 provides a cross-sectional side view of the exemplary bin assembly of FIG. 4 within a refrigerator appliance.
Figure 6:
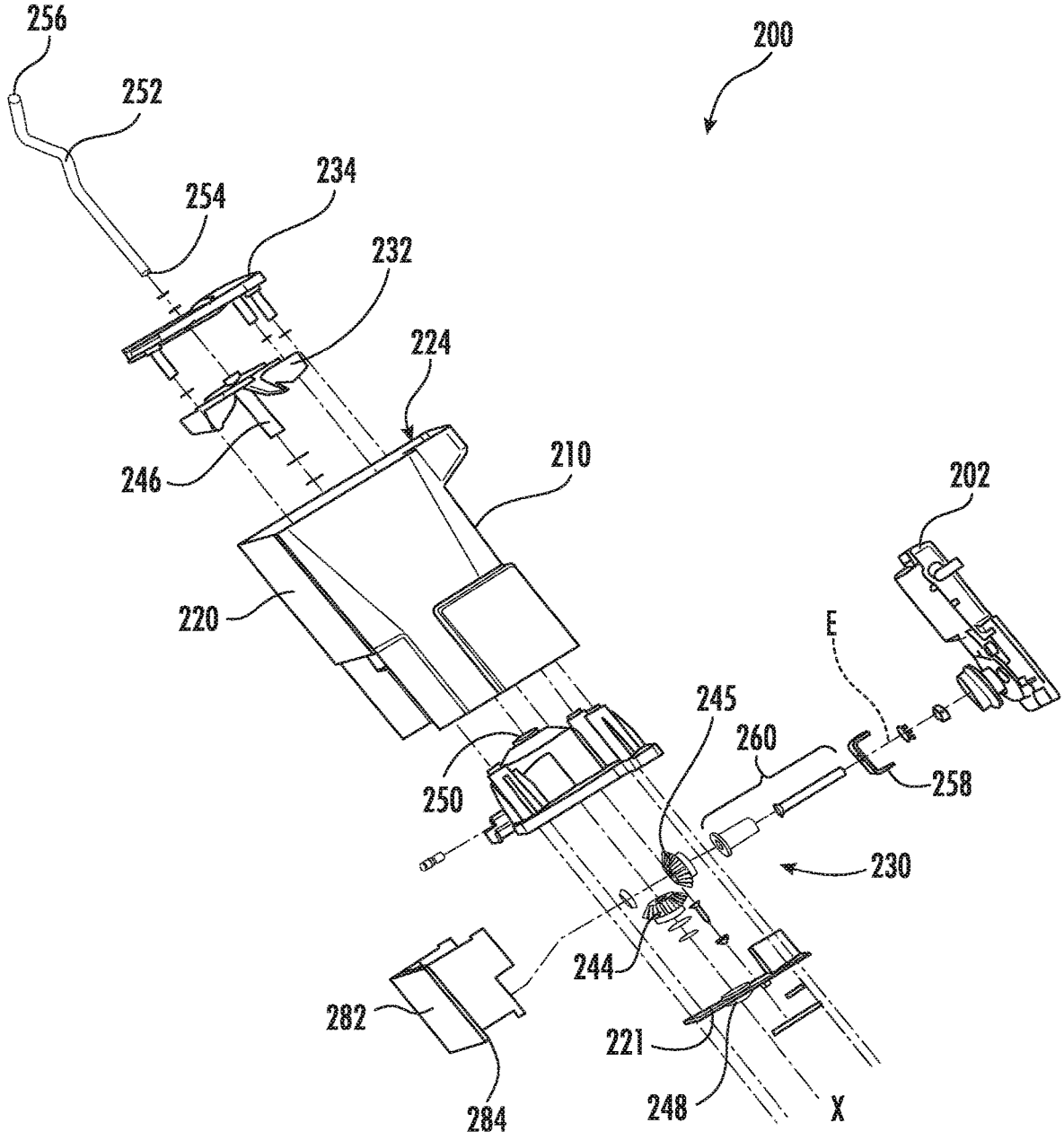
FIG. 6 provides an exploded perspective view of the exemplary bin assembly of FIG. 4.
Figure 7:
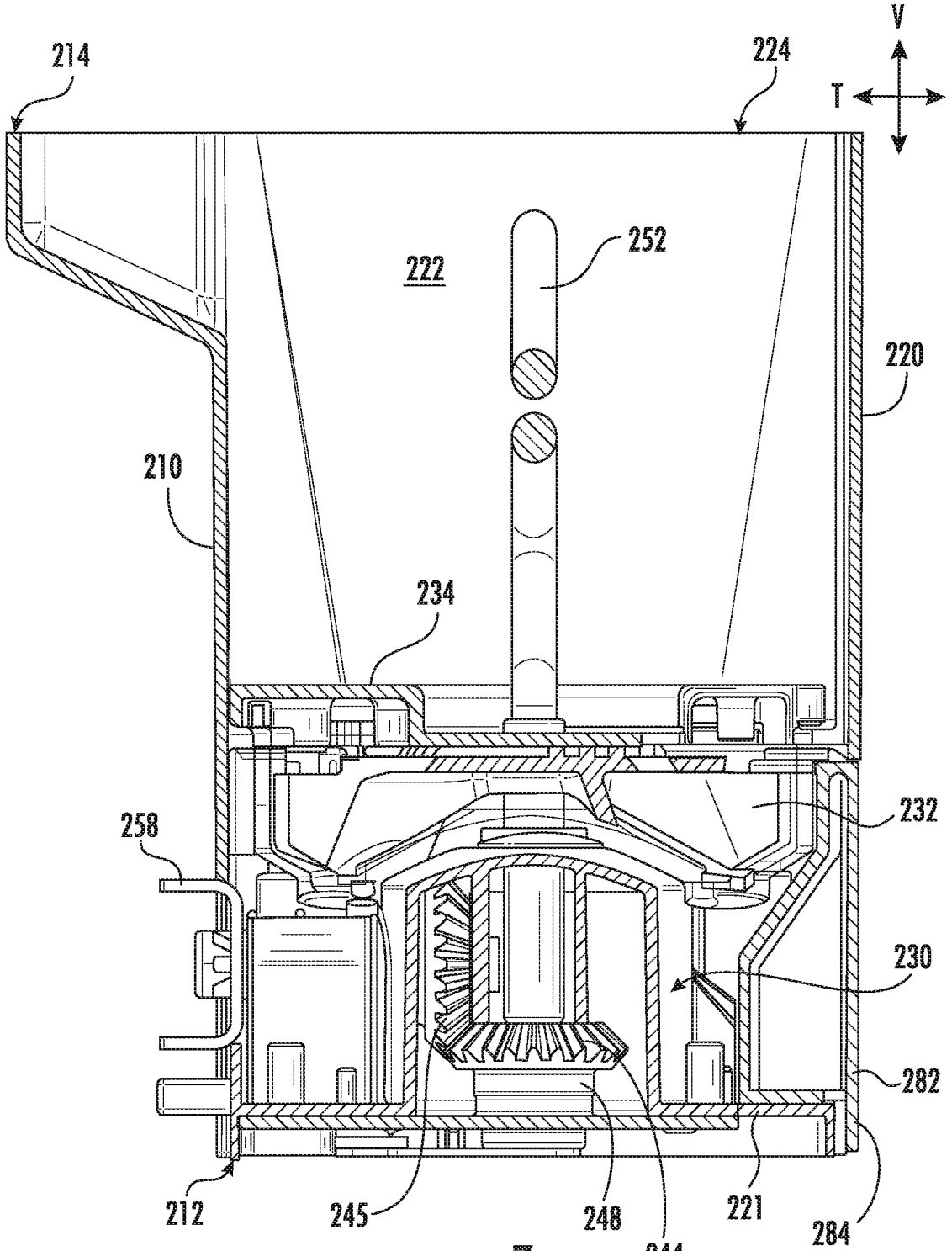
FIG. 7 provides a cross-sectional side view of the exemplary bin assembly of FIG. 4.
Figure 8:
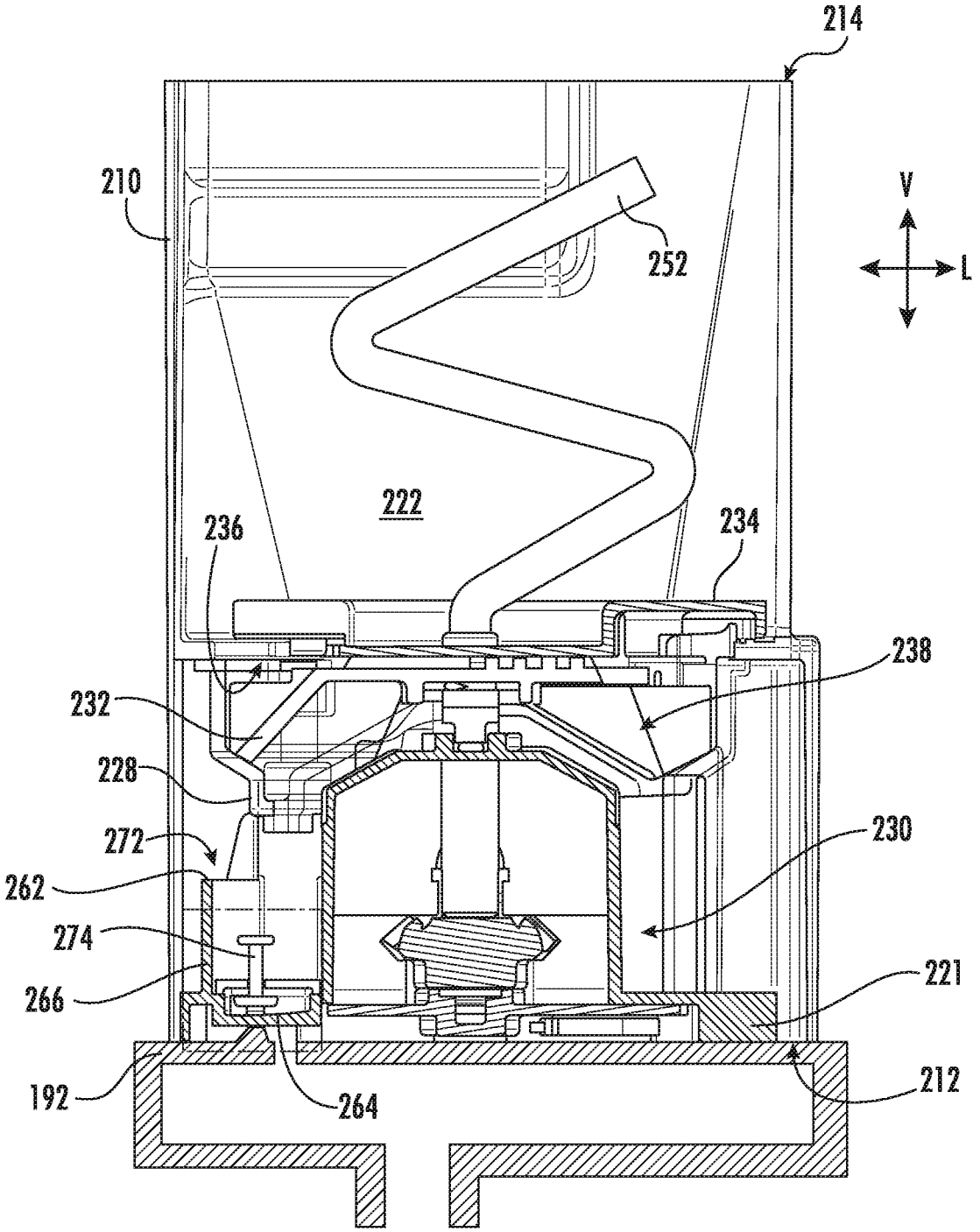
FIG. 8 provides a cross-sectional rear view of the exemplary bin assembly of FIG. 4 within a refrigerator appliance.

In some embodiments, refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. As discussed in greater detail below, an ice maker or ice making assembly 160 and an ice storage bin 164 (FIG. 3) are positioned or disposed within sub-compartment 162. For instance, ice making assembly 160 may be positioned, at least in part, above ice storage bin 164 mounted on a supporting surface 192 (e.g., defined by an inner wall of door 128). Thus, ice is supplied to dispenser recess 150 (FIG. 1) from the ice making assembly 160 or ice storage bin 164 in sub-compartment 162 on a back side of refrigerator door 128. Chilled air from a sealed system (not shown) of refrigerator appliance 100 may be directed into components within sub-compartment 162 (e.g., ice making assembly 160 or storage bin 164 assembly). A bin motor 202 may be in mechanical communication with an ice sweep 232 or ice agitator 252 (FIG. 4) of ice storage bin 164, as will be described in greater detail below. In some embodiments, bin motor 202 is mounted to door 128 (e.g., indirectly attached to cabinet 102), as illustrated. In other embodiments, bin motor 202 is mounted within fresh food chamber 122 or freezer chamber 124 (e.g., directly attached to cabinet 102).

In optional embodiments, an access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162 (e.g., by thermally isolating or insulating sub-compartment 162 from fresh food chamber 122). It is noted that although an access door 166 is illustrated in exemplary embodiments, alternative embodiments may be free of any separate access door. For instance, ice storage bin 164 may be immediately visible upon opening door 128.

In certain embodiments, ice making assembly 160 is positioned or disposed within sub-compartment 162. As illustrated, ice making assembly 160 may include a mold body or casing 170. In some such embodiments, auger 172 is rotatably mounted in a mold body within casing 170 (shown partially cutout to reveal auger 172). In particular, a motor 174 is mounted to casing 170 and is in mechanical communication with (e.g., coupled to) auger 172. Motor 174 is configured for selectively rotating auger 172 in the mold body within casing 170. During rotation of auger 172 within the mold body, auger 172 scrapes or removes ice off an inner surface of the mold body within casing 170 and directs such ice to an extruder 175. At extruder 175, ice nuggets are formed from ice within casing 170. An ice bucket or storage bin assembly 164 is positioned below extruder 175 and receives the ice nuggets from extruder 175. From storage bin assembly 164, the ice nuggets can enter dispensing assembly 140 and be accessed by a user as discussed above. In such a manner, ice making assembly 160 can produce or generate ice nuggets.

Ice making assembly 160 also includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice making assembly 160 is air cooled in order to form ice therein. Ice making assembly 160 also includes a heater 180, such as an electric resistance heating element, mounted to casing 170. Heater 180 is configured for selectively heating casing 170 (e.g., when ice prevents or hinders rotation of auger 172 within casing 170).

It is noted that although ice making assembly 160 is illustrated as a nugget ice maker, the present disclosure is not limited to any particular style or configuration for making ice. As is understood by one of ordinary skill, other exemplary embodiments may include an ice making assembly configured to make ice flakes, solid pieces of ice (e.g., cubes or crescents), or any other suitable form of frozen ice.

Operation of refrigerator appliance 100 is generally controlled by a processing device or controller 190. Controller 190 may, for example, be operatively coupled to control panel 148 for user manipulation to select features and operations of refrigerator appliance 100, such as ice bin 164 or ice making assembly 160. Controller 190 can operate various components of refrigerator appliance 100 to execute selected system cycles and features. In exemplary embodiments, controller 190 is in operative communication (e.g., electrical or wireless communication) with ice bin 164. In additional or alternative embodiments, controller 190 is in operative communication with ice making assembly 160 (e.g., at motor 174, fan 176, and heater 180). Thus, controller 190 can selectively activate and operate ice bin 164, motor 174, fan 176, or heater 180.

Controller 190 may include a memory and microprocessor, such as a general or special purpose microprocessor operable to execute programming instructions or micro-control code associated with operation of ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software. One or more portions of storage bin assembly 164, bin motor 202, or ice making assembly 160 may be in communication with controller 190 via one or more signal lines or shared communication busses.

In optional embodiments, ice making assembly 160 also includes a temperature sensor 178. Temperature sensor 178 is configured for measuring a temperature of casing 170 or liquids, such as liquid water, within casing 170. Temperature sensor 178 can be any suitable device for measuring the temperature of casing 170 or liquids therein. For example, temperature sensor 178 may be a thermistor or a thermocouple. Controller 190 can receive a signal, such as a voltage or a current, from temperature sensor 190 that corresponds to the temperature of the temperature of casing 170 or liquids therein. In such a manner, the temperature of casing 170 or liquids therein can be monitored or recorded with controller 190.

Turning now generally to FIGS. 4 through 21, various views are provided of a storage bin assembly 200 according to exemplary embodiments of the present disclosure. Storage bin assembly 200 may be used within and selectively attached to a cabinet 102 of a refrigerator appliance 100 (FIG. 2). When attached, storage bin assembly 200 may thus be received within a chilled chamber (e.g., fresh food chamber 122 or freezer chamber 124) of the corresponding refrigerator appliance 100. As an example, storage bin assembly 200 may selectively attach to cabinet 102 at a bracket or support surface fixed within a chilled chamber of refrigerator appliance 100. As another example, storage bin assembly 200 may selectively attach to cabinet 102 at a door 128 of refrigerator appliance 100 (e.g., support surface 192). In exemplary embodiments, storage bin assembly 200 is provided as, or as part of, ice bin 164 (FIG. 3).

As described herein, it is understood that the vertical direction V, lateral direction L, and transverse direction T described within the context of FIGS. 4 through 21 generally correspond to storage bin assembly 200 in isolation. However, these directions may also align with (e.g. be parallel to) the respective vertical direction V, lateral direction L, and transverse direction T defined by refrigerator appliance 100 (FIG. 1) when storage bin assembly 200 is attached or mounted to a door 128 (FIG. 1) in the closed position.

Turning particularly to FIGS. 4 through 7, storage bin assembly 200 generally includes a bin body 210 extending along the vertical direction V from a bottom end 212 to a top end 214. Bin body 210 may generally be formed as a solid, nonpermeable structure having one or more sidewalls 220 defining a storage volume 222 to receive ice therein (e.g., from ice making assembly 160—FIG. 3). One portion of bin body 210 (e.g., sidewalls 220) may be formed from a transparent material, such as a suitable rigid polymer (e.g., acrylic, polycarbonate, etc.), through which a user may view the contents of storage volume 222. At top end 214, bin body 210 defines a bin opening 224 through which ice may pass into storage volume 222. Below top end 214 (e.g., at a bottom end 212), bin body 210 may define a dispenser opening 226 through which ice may pass from storage volume 222 (e.g., to dispensing assembly 140—FIG. 1). In some embodiments, the entirety of top end 214 is open and unobstructed. Top end 214 and bin opening 224 may be free of any lid or enclosing portion. Optionally, bin opening 224 may define a radial or horizontal maximum of storage volume 222 (i.e., the maximum radial or horizontal width of storage volume 222). Advantageously, bin opening 224 may provide easy and direct access to storage volume 222 through which ice may pass. A user may thus easily scoop or pour large amounts ice from storage volume 222 directly through bin opening 224.

As shown, a gear assembly 230 is provided within bin body 210 below storage volume 222. An ice sweep 232 positioned within bin body 210 may be in mechanical communication with gear assembly 230 to rotate about a predetermined axis (e.g., a sweep axis X or parallel to the vertical direction V). In some such embodiments, ice sweep 232 is positioned below storage volume 222. In additional or alternative embodiments, ice sweep 232 is positioned above dispenser opening 226. During use, ice sweep 232 may thus rotate (e.g., as directed by gear assembly 230) and motivate or direct ice within storage volume 222 to dispenser opening 226. Advantageously, the gear assembly 230 may establish a low center of gravity for bin assembly 200 and prevent accidental tipping of bin assembly 200 (e.g., when removed from refrigerator appliance 100 and placed on a counter). Further advantageously, the illustrated gear assembly 230 may permit a user to easily mount or remove bin assembly 200.

In certain embodiments, an ice cover 234 is positioned between ice sweep 232 and storage volume 222 along the vertical direction V may at least partially cover ice sweep 232 and provide support to ice within storage volume 222. Ice cover 234 may thus at least partially define a bottom extreme of storage volume 222. In some such embodiments, ice cover 234 defines a cover opening 236 that generally extends along the vertical direction V between storage volume 222 and ice sweep 232. In certain embodiments, cover opening 236 is vertically offset (e.g., circumferentially spaced apart from) dispenser opening 226. In other words, cover opening 236 may be misaligned from dispenser opening 226 along the vertical direction V. An internal guide wall 228 within bin body 210 below ice sweep 232 may define a channel 238 in fluid communication between cover opening 236 and dispenser opening 226. Optionally, internal guide wall 228 may have a frustoconical shape defined about sweep axis X. A vertical containment wall 240 may extend from, and about, a portion of internal guide wall 228. A radial internal opening 242 may be defined by internal guide wall 228 and vertical containment wall 240. As shown, radial opening 242 may be positioned above, and in upstream fluid communication with, dispenser opening 226.

During use, ice may pass from cover opening 236 to dispenser opening 226 through the channel 238 defined by an internal guide wall 228. As ice sweep 232 rotates, ice within storage volume 222 may thus pass through cover opening 236 to ice sweep 232 (e.g., as motivated by gravity). Ice sweep 232 may then motivate or direct such ice along internal guide wall 228, through a radial internal opening 242, and to dispenser opening 226.

As shown, the gear assembly 230 generally includes one or more rotatable gears in mechanical communication with ice sweep 232. In particular, a sweep gear 244 may be connected to ice sweep 232 below storage volume 222. For instance, sweep gear 244 may be fixed to ice sweep 232 (e.g., through a vertical shaft 246 extending from ice sweep 232) and rotatable about a sweep axis X. In some such embodiments, rotation of sweep gear 244 may be directly transferred to ice sweep 232. One or more stabilizing bearings 248, 250 may be fixed within bin body 210 (e.g., in horizontal or radial support of sweep gear 244). For instance, a bottom stabilizing bearing 248 may be radially positioned between sweep gear 244 and a base wall 221 of bin body 210. Moreover, bottom stabilizing bearing 248 may be vertically positioned below sweep gear 244. Additionally or alternatively, a top stabilizing bearing 250 may be radially positioned between vertical shaft 246 and the internal guide wall 228. Moreover, top stabilizing bearing 250 may be positioned above sweep gear 244. As shown, top stabilizing bearing 250 may be also positioned below ice sweep 232 or internal storage volume 222. Advantageously, the stabilizing bearings the may ensure sweep gear 244 maintains vertical alignment along the sweep axis X during use.

In some embodiments, an ice agitator 252 is positioned within storage volume 222. For instance, ice agitator 252 may extend vertically through or from ice cover 234 to a location within storage volume 222 (e.g., below bin opening 224). In some such embodiments, ice agitator 252 includes, or is provided as, a single, continuous, folded wire. The wire of ice agitator 252 may extend as an integral (e.g., unitary and monolithic) structure from a fixed end 254 (e.g., connecting the gear assembly 230) to a free end 256 uncovered and unsupported within storage volume 222. In certain embodiments, ice agitator 252 is fixed to ice sweep 232. Both ice agitator 252 and ice sweep 232 may thus rotate in tandem about sweep axis X. Optionally, one or more sealing structures (e.g., mated gasket-channel about sweep axis X) may be formed on ice sweep 232 or ice agitator 252 to prevent water from flowing to gear assembly 230. As an example, one gasket may be positioned on ice sweep 232 between vertical shaft 248 and internal guide wall 229. As another example, a separate gasket may be positioned on ice agitator 252 between ice agitator 252 and cover 234 or top bearing 250.

Within bin body 210, a drive gear 245 may be positioned in mechanical communication with sweep gear 244 (e.g., such that sweep gear 244 is in mechanical communication between ice sweep 232 and drive gear 245). For instance, drive gear 245 and sweep gear 244 may both include a plurality of gear teeth that are enmeshed in mechanical communication with each other. When assembled, drive gear 245 may be rotatable about a unique drive axis E that is not parallel to sweep axis X. For instance, drive axis E may be perpendicular to sweep axis X. Moreover, one or both of sweep gear 244 and drive gear 245 may be provided as bevel gears.

In certain embodiments, an adapter key 258 is connected to drive gear 245 through bin body 210. For instance, a gear shaft 260 may extend through bin body 210 from drive gear 245 to adapter key 258. In some such embodiments, gear shaft 260 and adapter key 258 are both fixed to drive gear 245 and rotatable about drive axis E. When storage bin assembly 200 is positioned on refrigerator appliance (e.g., attached to a door 128—FIG. 3), adapter key 258 may engage bin motor 202 in a horizontal connection beside bin body 210. Adapter key 258 may thus establish mechanical communication between bin motor 202 and gear assembly 230. During use, bin motor 202 may motivate rotation of adapter key 258 and drive gear 245 about the drive axis E, which in turn motivates rotation of sweep gear 244 and ice sweep 232 about the sweep axis X. The horizontal connection between bin motor 202 and gear assembly 230 may permit storage bin assembly 200 to slide horizontally (i.e., perpendicular to the vertical direction V) into attachment with refrigerator appliance 100 (FIG. 2) without requiring any vertical movement or motion from storage bin assembly 200. Advantageously, a user may attach or remove storage bin assembly 200 from refrigerator appliance 100 without lifting storage bin assembly 200 up and over bin motor 202 or, for example, support surface 192.

Turning now to FIGS. 8 through 15, a reservoir body 262 may be fixed to or contained within bin body 210 below the ice sweep 232. Reservoir body 262 generally includes one or more nonpermeable walls, such as a reservoir base wall 264 and reservoir radial wall 266 extending therefrom. Generally, reservoir body 262 may be in fluid communication with the storage volume 222 (e.g., downstream from storage volume 222) to receive water from melted ice within bin body 210. For instance, in some such embodiments, one or more melt apertures 268 are defined through internal guide wall 228 (e.g., along the vertical direction V directly above reservoir body 262). As ice melts, liquid water may thus collect along internal guide wall 228 before naturally flowing (e.g., as motivated by gravity) downstream through melt aperture 268 into reservoir body 262. In certain embodiments, a drain aperture 270 is defined through reservoir body 262 (e.g., through reservoir base wall 264) to permit water therein to flow to another downstream portion of refrigerator appliance 100 (FIG. 2) (e.g., when attached thereto).

Figure 10:
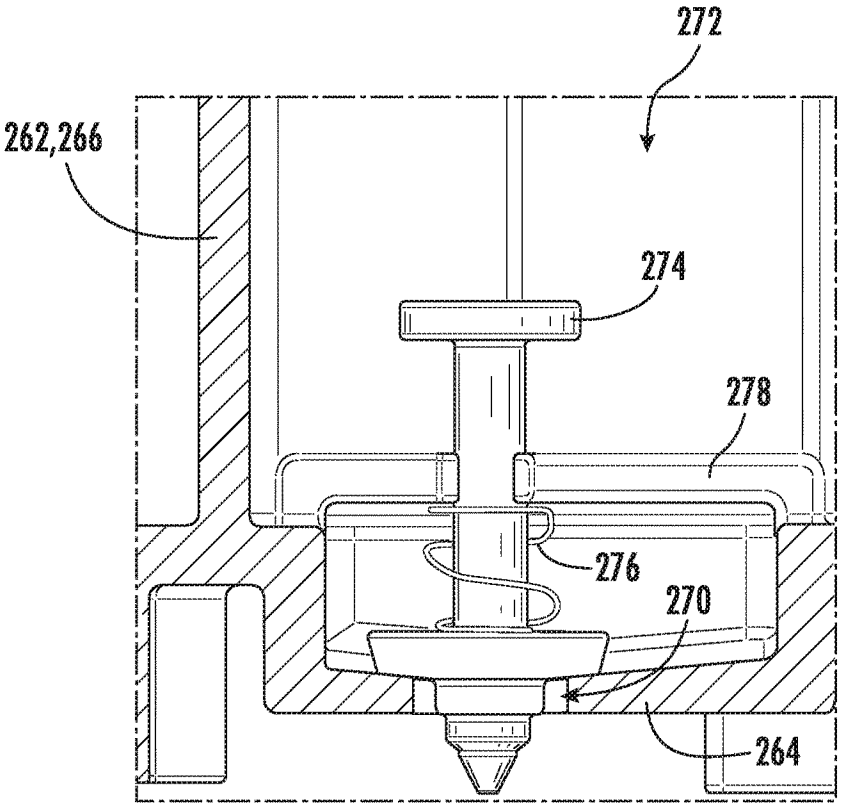
FIG. 10 provides a magnified cross-sectional view of a portion of the exemplary bin assembly of FIG. 8 in a sealed position.
Figure 9:
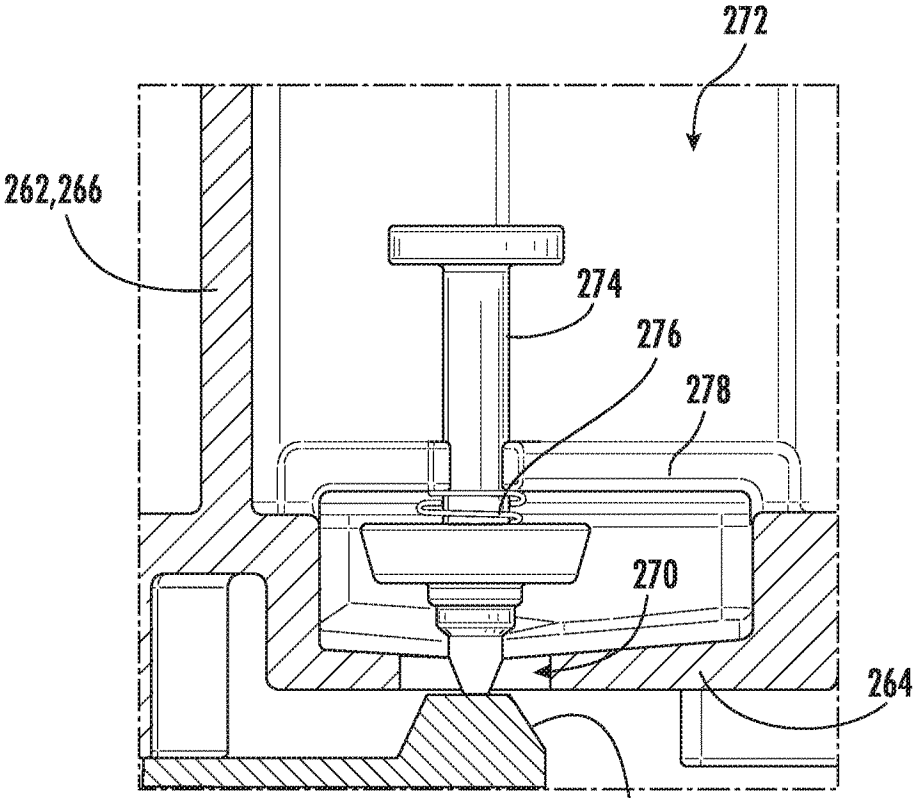
FIG. 9 provides a magnified cross-sectional view of a portion of the exemplary bin assembly of FIG. 8 in an unsealed position.
Figure 12:
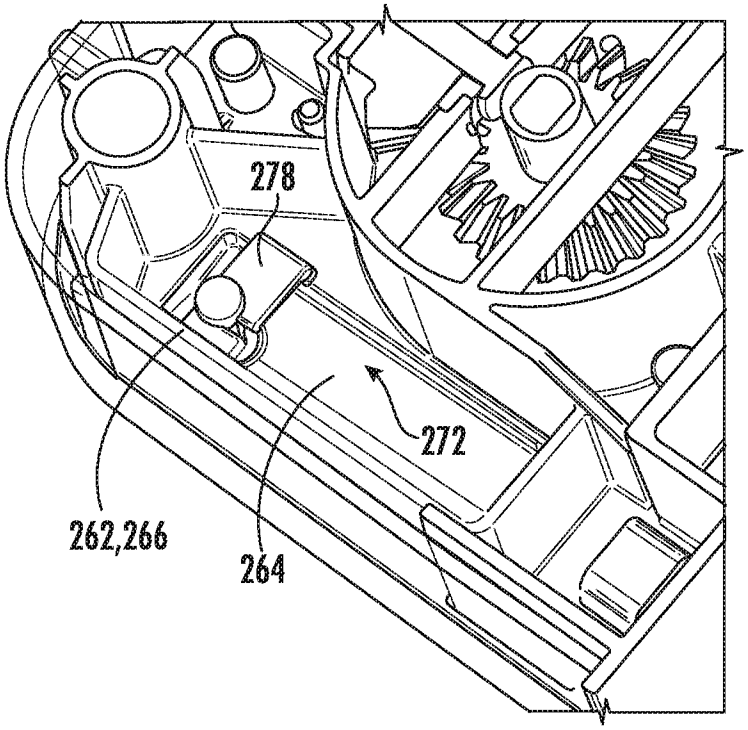
FIG. 12 provides a cross-sectional perspective view of the exemplary bin assembly of FIG. 11 taken along the line 12-12.
Figure 11:
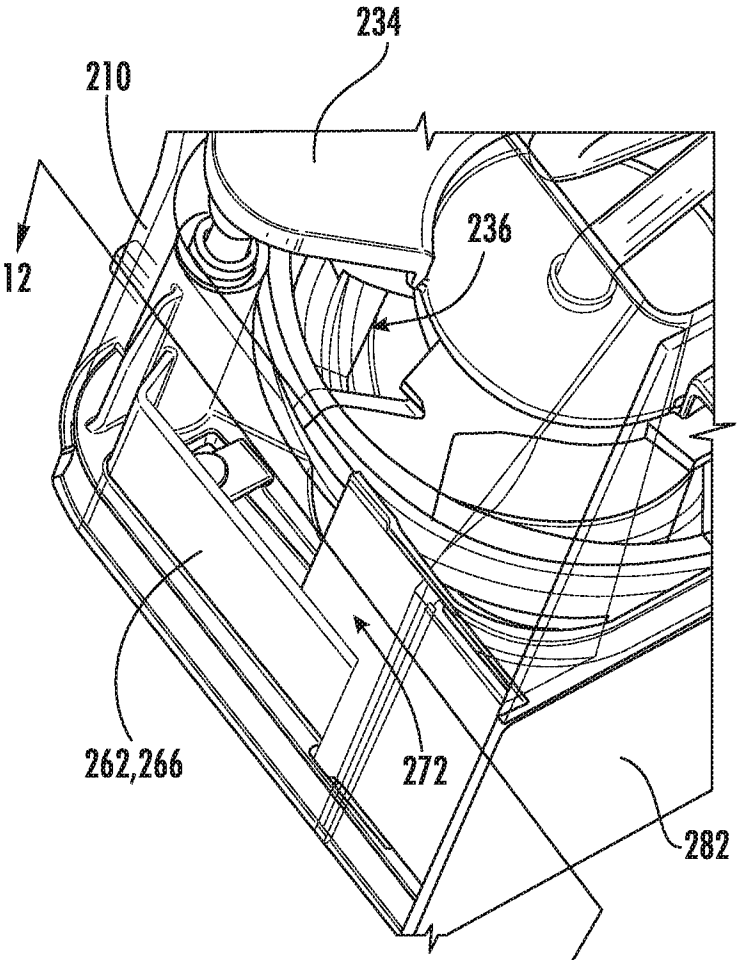
FIG. 11 provides a partial perspective view of a bin assembly according to exemplary embodiments of the present disclosure.
Figure 13:
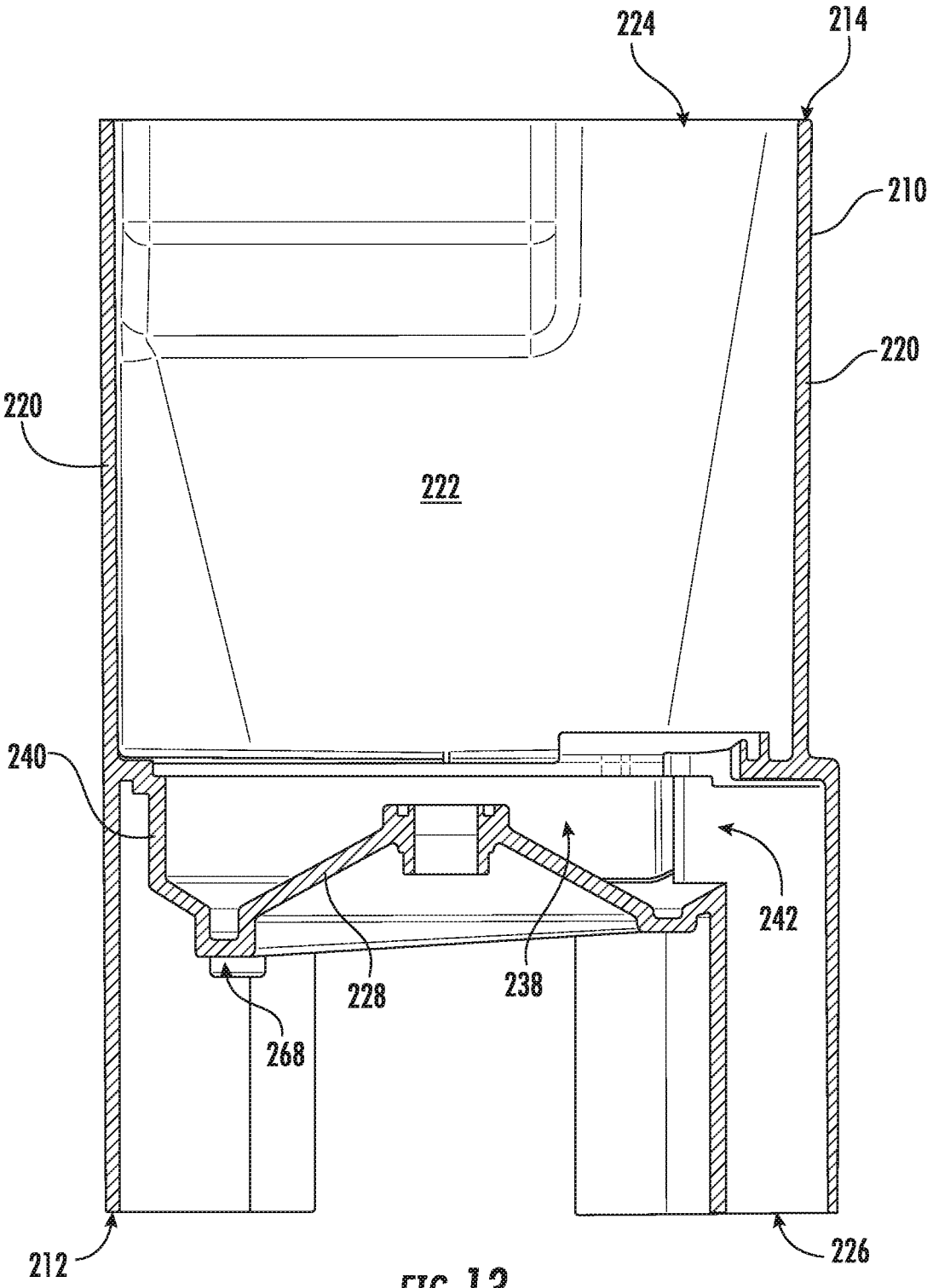
FIG. 13 provides a cross-sectional side view of a bin body of an ice bin assembly according to exemplary embodiments of the present disclosure.
Figure 14:
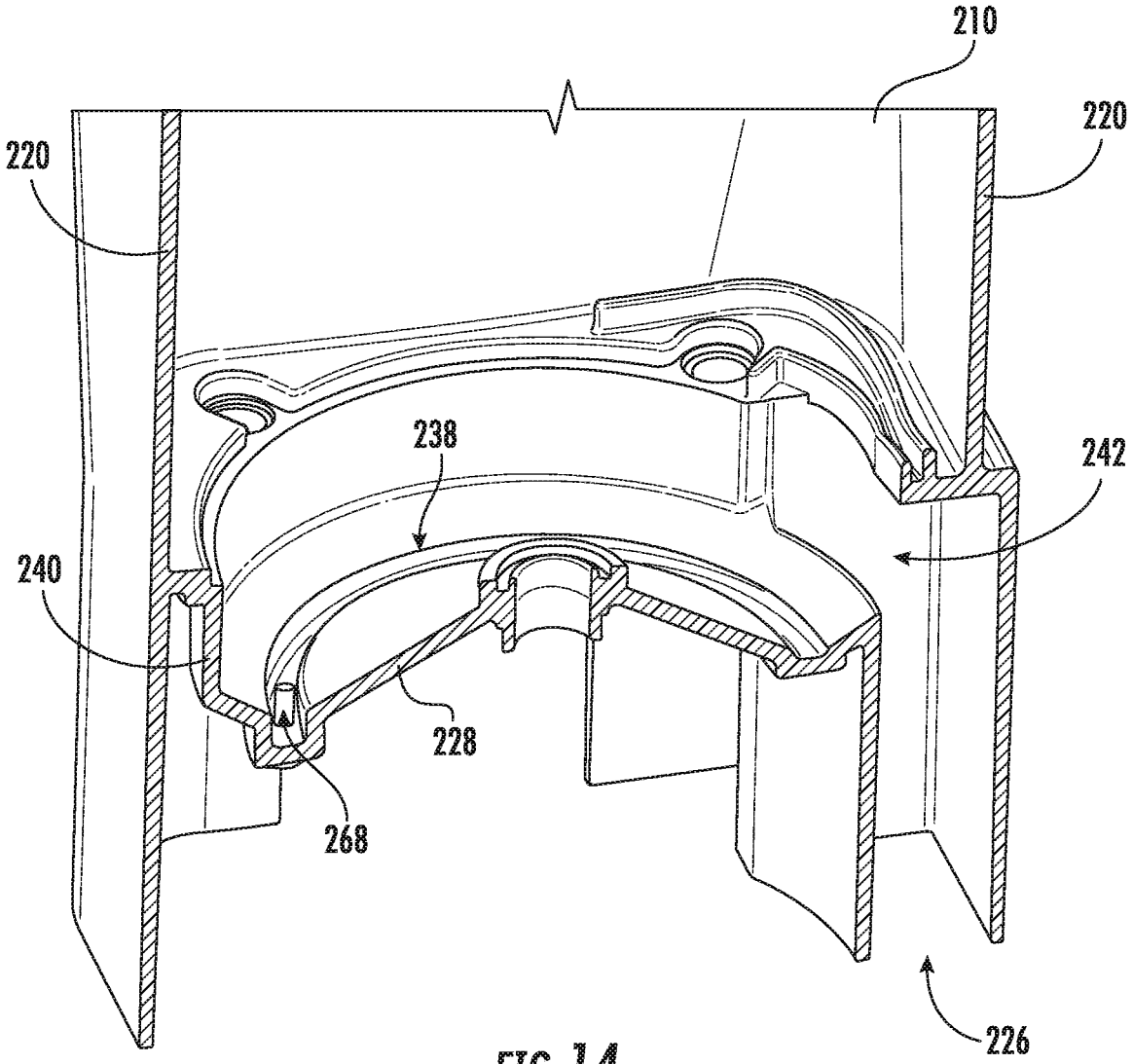
FIG. 14 provides a cross-sectional perspective view of the exemplary bin body of FIG. 13.

In optional embodiments, storage bin assembly 200 includes a selective sealing system 272 to selectively permit or restrict water from exiting reservoir body 262. In exemplary embodiments, a resilient or biased sealing plug 274 is paired to drain aperture 270. For instance, biased sealing plug 274 may be slidable along the vertical direction V within drain aperture 270. Generally, sealing system 272 selectively fills or blocks drain aperture 270 according to a condition of storage bin assembly 200. For instance, in a fully mounted condition (e.g., wherein storage bin assembly 200 is fully attached to and supported on refrigerator appliance 100—FIG. 2), biased sealing plug 274 may be positioned away from drain aperture 270, as illustrated in FIG. 9. Water may be permitted to freely pass downstream through drain aperture 270. In a non-fully mounted condition, biased sealing plug 274 may extend to or through drain aperture 270, directly engaging a portion of reservoir body 262, as illustrated in FIG. 10. Water may be substantially prevented or restricted from passing through drain aperture 270.

A spring 276 may be attached to biased sealing plug 274 in biased engagement. Spring 276 may generally urge biased sealing plug 274 toward drain aperture 270. For instance, spring 276 may be embodied as a compression spring. Spring 276 may be positioned between a support tab 278 and biased sealing plug 274. In some such embodiments, support tab 278 is fixed within reservoir body 262.

A plug prong 280 may be provided in some embodiments of sealing system 272. For instance, plug prong 280 may be attached to cabinet 102 (FIG. 2) (e.g., at a support surface 192 of door 128). In some such embodiments, a vertical recess is defined below the reservoir base wall 264 to receive plug prong 280. When storage bin assembly 200 is in a mounted condition (see FIGS. 8 and 9), plug prong 280 may extend through the vertical recess and contact a distal tip of biased sealing plug 274. Plug prong 280 162 may thus engage biased sealing plug 274 through drain aperture 270, forcing biased sealing plug 274 toward spring 276 and away from drain aperture 270. When storage bin assembly 200 is positioned away from plug prong 280, such as in a non-mounted condition (see FIG. 10), plug prong 280 may be disengaged from biased sealing plug 274. Spring 276 may force plug toward drain aperture 270, preventing undesired leaks.

Figure 16:
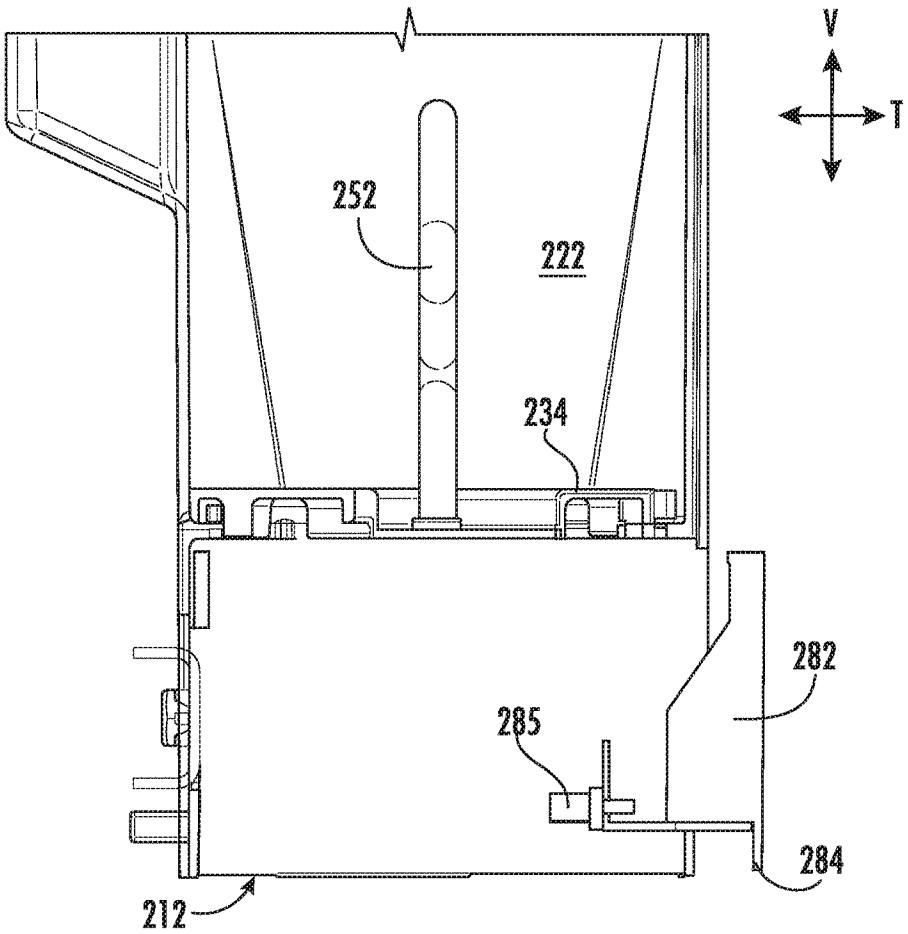
FIG. 16 provides a simplified, cross-sectional, side view of a bin assembly according to exemplary embodiments of the present disclosure, wherein the handle is an open position.
Figure 15:
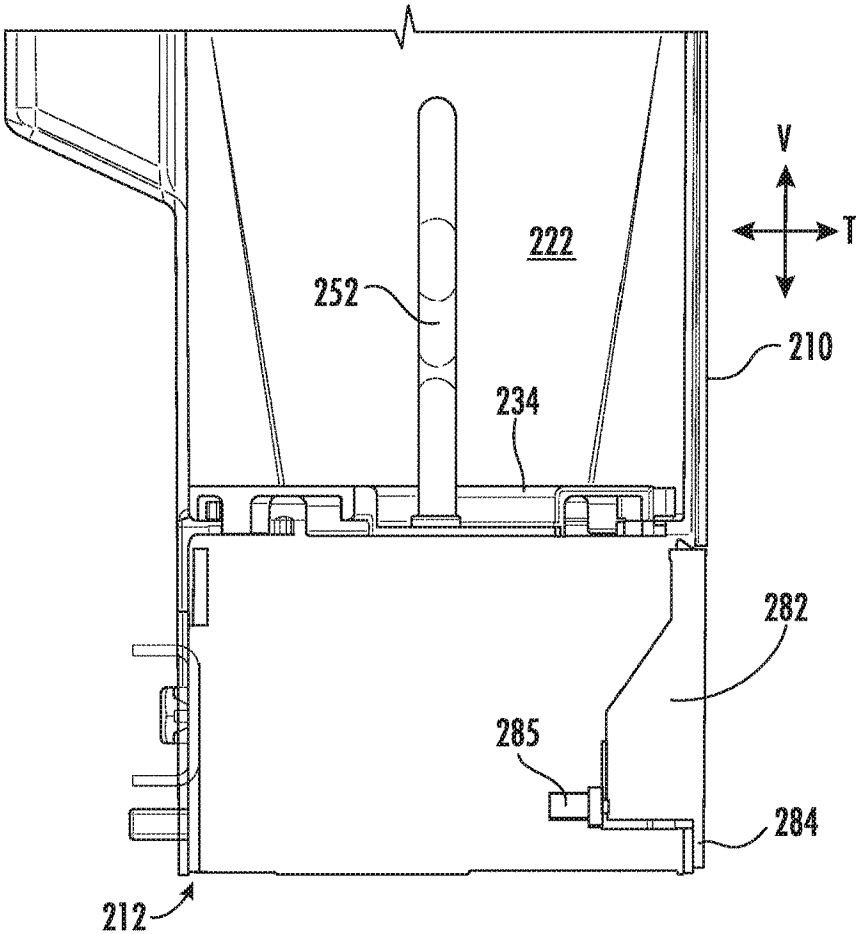
FIG. 15 provides a simplified, cross-sectional, side view of a bin assembly according to exemplary embodiments of the present disclosure, wherein the handle is a retracted position.

Turning now particularly to FIGS. 15 and 16, some embodiments include a retractable handle 282 mounted to bin body 210 and movable between a retracted position (FIG. 15) and an open position (FIG. 16). For instance, retractable handle 282 may be slidably mounted to bin body 210 to move, for example perpendicular to vertical direction V (e.g., along the transverse direction T). As illustrated, the open position extends retractable handle 282 radially or horizontally outward relative to the retracted position. In certain embodiments, retractable handle 282 is positioned adjacent to gear assembly 230 or below storage volume 222. Handle 282 may define a user grip 284 (e.g., at a bottom portion thereof) that is generally covered or inaccessible to a user in the retracted position and spaced apart from bin body 210 in the open position such that access (e.g., by user) is permitted. Optionally, one or more push-to-open latches 285 are mounted within bin body 210 to selectively engage retractable handle 282. Thus, pressing retractable handle 282 toward bin body 210 in the retracted position may cause the push-to-open latch 285 to extend outward (e.g., in the transverse direction T) and motivate retractable handle 282 away from bin body 210 (e.g., to the open position).

Advantageously, the sliding movement of the handle 282 may be parallel to and correspond with the horizontal movement provided when removing storage bin assembly 200 from refrigerator appliance 100 (FIG. 2).

Figure 17:
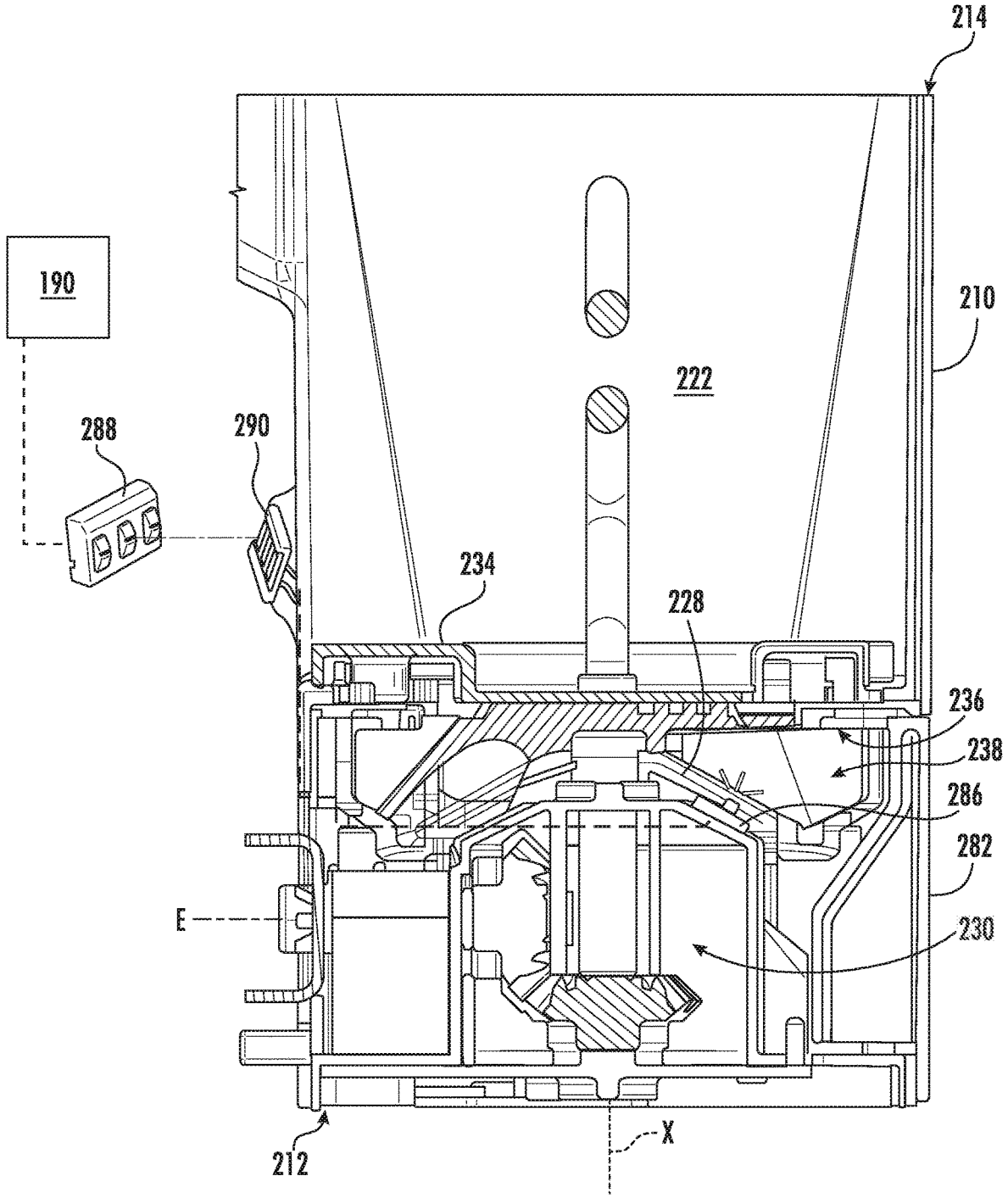
FIG. 17 provides a schematic view of a bin assembly in electrical communication with a contact plate of a refrigerator appliance according to exemplary embodiments of the present disclosure.

Turning now particularly to FIG. 17, optional embodiments include one or more light sources 286 fixed within bin body 210. Light source 286 may be directed to storage volume 222 to selectively illuminate the same. For instance, the light source 286 may be mounted on or below internal guide wall 228 and directed toward cover opening 236. Generally, light source 286 may be provided as any suitable electrical light-generating source (e.g., light emitting diode, fluorescent bulb, incandescent mold, etc.). In optional embodiments, light source 286 may be configured to act as a heat source, which selectively generates and directs heat to a portion of storage bin assembly 200 (e.g., storage volume 222, ice sweep 232, etc.).

In some embodiments, refrigerator appliance 100 (FIG. 2) provides an electrical contact plate 288 that is adjacent to storage bin assembly 200 when storage bin assembly 200 is mounted to refrigerator appliance 100 (i.e., in the fully mounted condition). For instance, the door 128 (FIG. 3) to which storage bin assembly 200 attaches may include an electrical contact plate 288 fixed thereto (e.g., in electrical communication with controller 190 or another suitable power source). A mating plate 290 may be provided on bin body 210 (e.g., at sidewall 220 or base wall 221) to selectively engage or contact electrical contact plate 288 (e.g., when storage bin assembly 200 is in the fully mounted condition). Mating plate 290 may be in electrical communication with light source 286 through one or more conductive wires or buses within bin body 210. Thus, the electrical contact plate 288 may be in electrical communication with light source 286 when storage bin assembly 200 is in the fully mounted condition. Optionally, controller 190 may be configured to selectively activate or illuminate light source 286 based on one or more predetermined conditions (e.g., opening of door 128).

Turning now generally to FIGS. 18 through 21, exemplary embodiments of storage bin assembly 200 include a locking system (e.g., mated latch and catch) to selectively hold storage bin assembly 200 in the fully mounted condition on support surface 192 (e.g., on door 128—FIG. 3). In some such embodiments, support surface 192 includes an internal latch 310 and storage bin assembly 200 includes a resilient catch 312. Internal latch 310 may extend along the vertical direction V from supporting surface 192 (i.e., from a base portion proximal to supporting surface 192 to an upper portion distal to supporting surface 192). Resilient catch 312, may be positioned at the bottom end 212 of bin body 210 to selectively engage internal latch 310. In particular, resilient catch 312 may be movable between a locked position and an unlocked position. The locked position may provide the resilient catch 312 in contact with the internal latch 310 and restrict radial or horizontal movement of storage bin assembly 200 relative to support surface 192 (e.g., door 128). The unlocked position may provide the resilient catch 312 at a location spaced apart from the internal latch 310 and thereby permit radial or horizontal movement of the storage bin assembly 200 (e.g., relative to support surface 192 along the transverse direction T).

Figure 19:
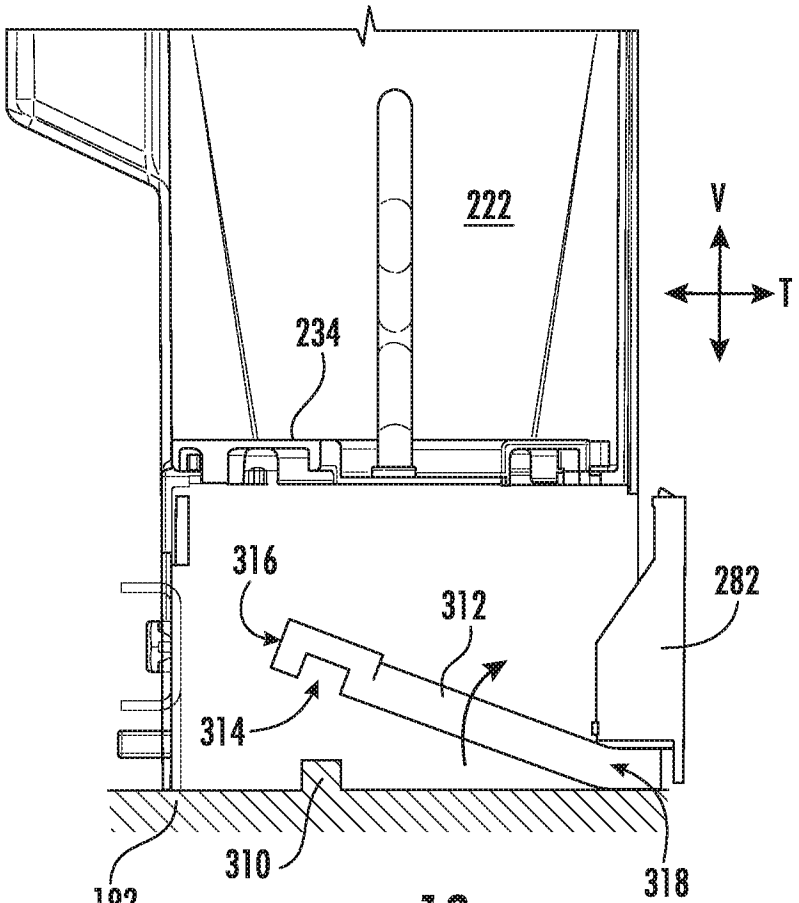
FIG. 19 provides a cross-sectional side view of a bin assembly within a refrigerator appliance in an unlocked position according to exemplary embodiments of the present disclosure.
Figure 18:
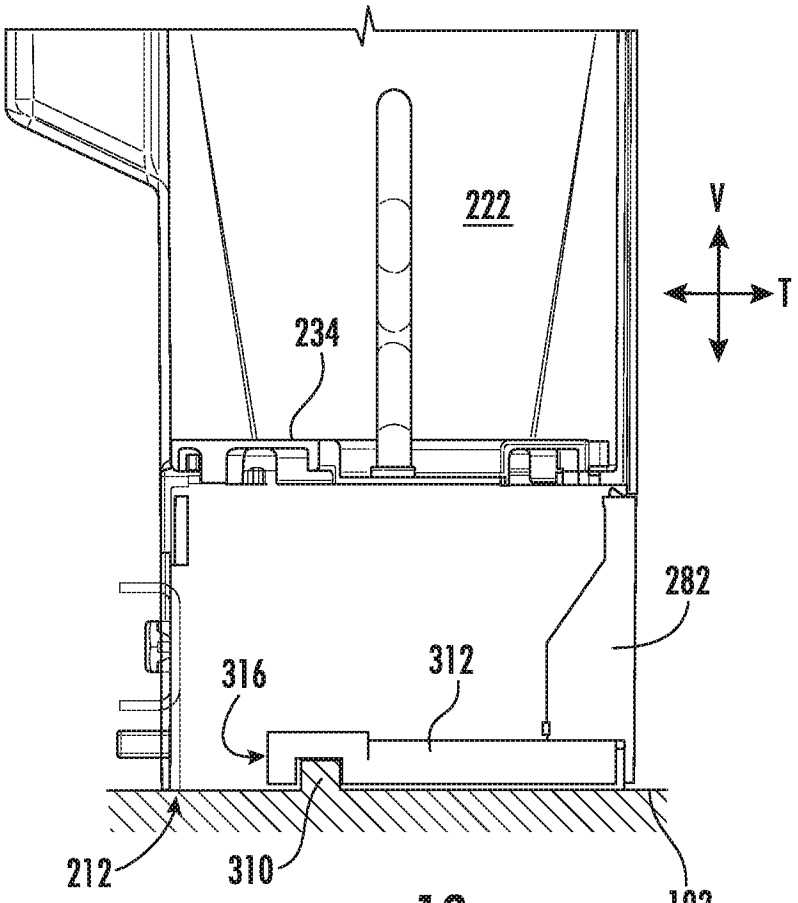
FIG. 18 provides a cross-sectional side view of a bin assembly within a refrigerator appliance in a locked position according to exemplary embodiments of the present disclosure.

Turning specifically to FIGS. 18 and 19, in some embodiments, resilient catch 312 includes, or is provided as, a spring plate. As shown, the spring plate resilient catch 312 may define a groove 314 matched to internal latch 310 (e.g., at a distal end 316 of resilient catch 312). An attached end 318 of resilient catch 312 may be mounted against a portion of bin body 210 (e.g., below retractable handle 282). The spring plate resilient catch 312 may be naturally biased away from internal latch 310. Thus, unless acted upon from an outside force or member, the spring plate resilient catch 312 may be spaced apart from internal latch 310. Specifically, in the locked position (FIG. 18), internal latch 310 may be received within groove 314. In the unlocked position (FIG. 19), the spring plate resilient catch 312 and groove 314 may be spaced apart from internal latch 310. In some such embodiments, the retractable handle 282 is slidable along a portion of the spring plate resilient catch 312 (e.g., at attached end 318). For example, retractable handle 282 may be in motivating engagement with the spring plate resilient catch 312. In the retracted position, the retractable handle 282 may urge the spring plate resilient catch 312 into the locked position. In the open position retractable handle 282 may permit the spring plate resilient catch 312 to bend upward to the unlocked position. In some such embodiments, the retracted position of the retractable handle 282 may correspond to the locked position of the resilient catch 312 while the open position of the retractable handle 282 corresponds to the unlocked position of the resilient catch 312.

Figure 21:
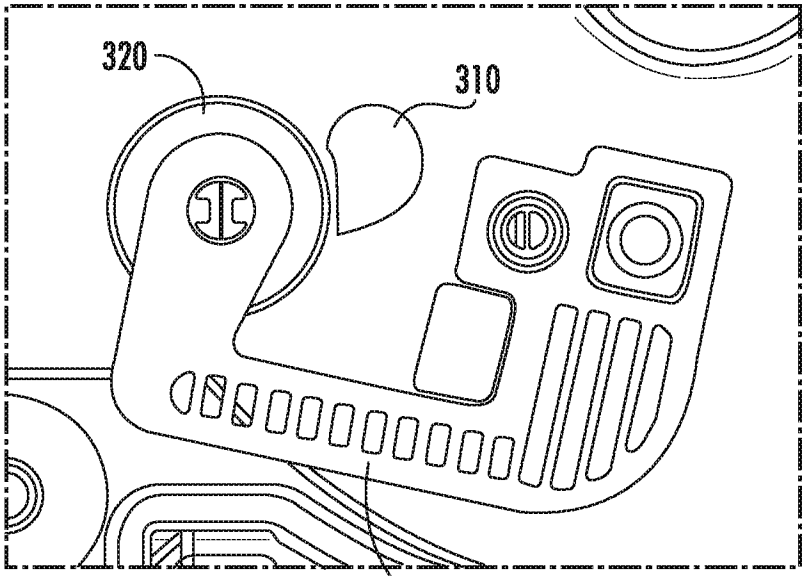
FIG. 21 provides a magnified perspective view of a portion of the embodiment of FIG. 20.
Figure 20:
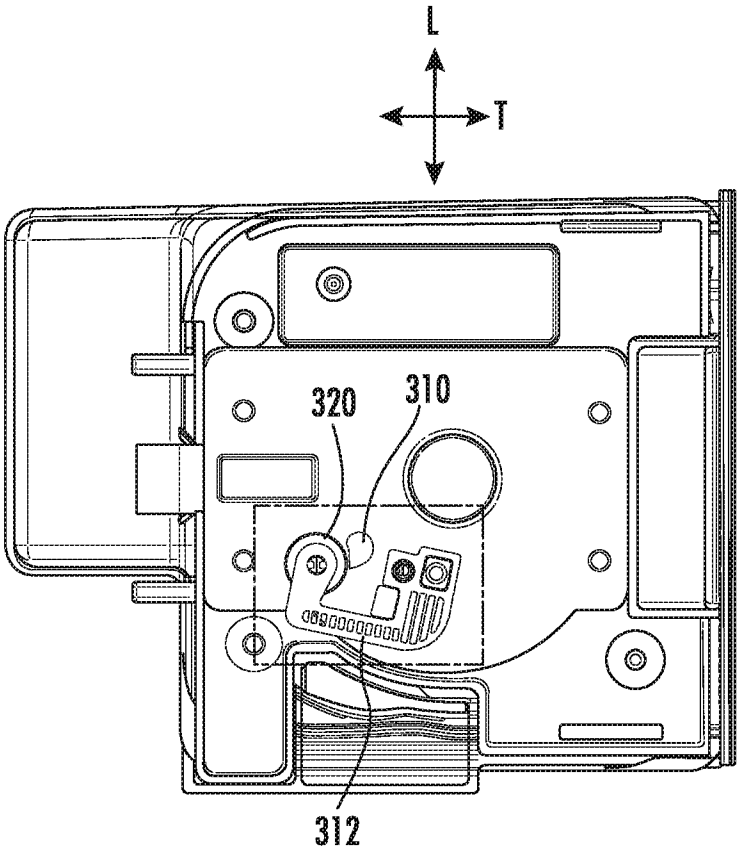
FIG. 20 provides a bottom perspective view of a bin assembly within a refrigerator appliance in a locked position according to exemplary embodiments of the present disclosure.

Turning specifically to FIGS. 20 and 21, in additional or alternative embodiments, resilient catch 312 includes or is provided as a rotatable cam 320. In some such embodiments, the rotatable cam 320 is rotatable about a pivot axis (e.g., parallel to the vertical direction V—FIG. 4). In the locked position, rotatable cam 320 may be held against the internal latch 310. As the storage bin assembly 200 is moved radially or horizontally, the rotatable cam 320 may slide along and subsequently past internal latch 310. Thus, in the unlocked position, the rotatable cam 320 and resilient catch 312 are spaced apart from internal latch 310 (e.g., perpendicular to the vertical direction V).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, the refrigerator appliance comprising:

a cabinet defining a chilled chamber;

a door rotatable between an open position permitting access to the chilled chamber and a closed position restricting access to the chilled chamber; and an ice bin removably received within the chilled chamber, the ice bin being slidable along a horizontal direction, the ice bin comprising a bin body defining a storage volume to receive ice therein, an ice sweep positioned within the ice bin, a gear assembly positioned within the ice bin below the ice sweep in mechanical communication with the ice sweep to motivate rotation of the ice sweep, and a retractable handle mounted to the bin body and defining a user grip, the retractable handle being horizontally movable parallel to the horizontal direction of the ice bin between a retracted position restricting access to the user grip and an open position permitting access to the user grip, the retracted position comprising the handle proximal to the bin body, and the extended position comprising the handle distal to the bin body.

2. The refrigerator appliance of claim 1, wherein the ice bin further comprises a push-to-open latch mounted below the storage volume in contact with the retractable handle in the retracted position.

3. The refrigerator appliance of claim 1, wherein the ice bin further comprises an ice cover positioned between the ice sweep and the storage volume to support ice therein, the ice cover defining a cover opening extending along the vertical direction from the storage volume to the ice sweep.

4. The refrigerator appliance of claim 1, wherein the bin body extends along the vertical direction from a bottom end to a top end, and wherein the bin body defines a bin opening at the top end to receive ice into the storage volume.

5. The refrigerator appliance of claim 1, wherein the ice bin further comprises a light source fixed to the bin body and directed toward the storage volume to selectively illuminate the storage volume.

6. The refrigerator appliance of claim 5, wherein the ice bin further comprises a reservoir body comprising a plurality of reservoir walls fixed to the bin body below the ice sweep, the plurality of reservoir walls defining a melt chamber in fluid communication with the storage volume to receive water from melted ice therein, at least one wall of the plurality of walls defining a drain aperture in selective fluid communication with the melt chamber to direct water therefrom.

7. The refrigerator appliance of claim 6, wherein the ice bin further comprises a biased sealing plug paired with the drain aperture, the biased sealing plug being urged toward the drain aperture to selectively restrict fluid communication therethrough, and wherein the door comprises a plug prong selectively mated with the biased sealing plug to urge the biased sealing plug away from the drain aperture.

8. The refrigerator appliance of claim 1, wherein the ice bin further comprises a reservoir body comprising a plurality of reservoir walls fixed to the bin body below the ice sweep, the plurality of reservoir walls defining a melt chamber in fluid communication with the storage volume to receive water from melted ice therein, at least one wall of the plurality of walls defining a drain aperture in selective fluid communication with the melt chamber to direct water therefrom.

9. The refrigerator appliance of claim 8, wherein the ice bin further comprises a biased sealing plug paired with the drain aperture, the biased sealing plug being urged toward the drain aperture to selectively restrict fluid communication therethrough, and wherein the door comprises a plug prong selectively mated with the biased sealing plug to urge the biased sealing plug away from the drain aperture.

10. The refrigerator appliance of claim 1, wherein the door comprises an internal latch, and wherein the ice bin extends from a bottom end to a top end, and wherein the ice bin further comprises a resilient catch mounted at the bottom end in selective locked engagement with the internal latch.

11. The refrigerator appliance of claim 10, wherein the resilient catch comprises a cam rotatable about an axis parallel to the vertical direction.

12. The refrigerator appliance of claim 10, wherein the resilient catch comprises a spring plate naturally biased away from the internal latch.

13. The refrigerator appliance of claim 12, wherein the retractable handle is provided in motivating engagement with the spring plate in the retracted position, and wherein the retracted position of the retractable handle corresponds to the locked position of the resilient catch.

14. The refrigerator appliance of claim 10, wherein the ice bin further comprises a reservoir body comprising a plurality of reservoir walls fixed to the bin body below the ice sweep, the plurality of reservoir walls defining a melt chamber in fluid communication with the storage volume to receive water from melted ice therein, at least one wall of the plurality of walls defining a drain aperture in selective fluid communication with the melt chamber to direct water therefrom.

15. The refrigerator appliance of claim 14, wherein the ice bin further comprises a biased sealing plug paired with the drain aperture, the biased sealing plug being urged toward the drain aperture to selectively restrict fluid communication therethrough, and wherein the door comprises a plug prong selectively mated with the biased sealing plug to urge the biased sealing plug away from the drain aperture.

16. The refrigerator appliance of claim 10, wherein the ice bin further comprises a light source fixed to the bin body and directed toward the storage volume to selectively illuminate the storage volume.

17. A refrigerator appliance defining a vertical direction, the refrigerator appliance comprising:

a cabinet defining a chilled chamber;

a door rotatable between an open position permitting access to the chilled chamber and a closed position restricting access to the chilled chamber; and an ice bin extending from a bottom end to a top end and removably received within the chilled chamber, the ice bin being slidable along a horizontal direction, the ice bin comprising a bin body a storage volume to receive ice therein, an ice sweep positioned within the ice bin, a gear assembly positioned within the ice bin below the ice sweep in mechanical communication with the ice sweep to motivate rotation of the ice sweep, a resilient catch mounted at the bottom end, the resilient catch being movable between a locked position and an unlocked position, the locked position providing the resilient catch in contact with the internal latch and restricting horizontal movement of the ice bin relative to the door, the unlocked position providing the resilient catch at a location spaced apart from the internal latch and permitting horizontal movement of the ice bin relative to the door, and a retractable handle mounted to the bin body and defining a user grip, the retractable handle being horizontally movable parallel to the horizontal direction of the ice bin between a retracted position restricting access to the user grip and an open position permitting access to the user grip, the retracted position comprising the handle proximal to the bin body, and the extended position comprising the handle distal to the bin body.

18. A refrigerator appliance defining a vertical direction, the refrigerator appliance comprising:

a cabinet defining a chilled chamber;

a door rotatable between an open position permitting access to the chilled chamber and a closed position restricting access to the chilled chamber, the door including an electrical contact plate; and an ice bin removably received within the chilled chamber, the ice bin being slidable along a horizontal direction, the ice bin comprising a bin body defining a storage volume to receive ice therein, an ice sweep positioned within the ice bin, a gear assembly positioned within the ice bin below the ice sweep in mechanical communication with the ice sweep to motivate rotation of the ice sweep, a light source fixed to the bin body and directed toward the storage volume to selectively illuminate the storage volume, the light source being in selective electrical engagement with the electrical contact plate, and a retractable handle mounted to the bin body and defining a user grip, the retractable handle being horizontally movable parallel to the horizontal direction of the ice bin between a retracted position restricting access to the user grip and an open position permitting access to the user grip, the retracted position comprising the handle proximal to the bin body, and the extended position comprising the handle distal to the bin body.

* * * * *